United States Patent [19]

Kashio

[11] 4,089,156

[45] May 16, 1978

[54] STOP WATCH DEVICE

[75] Inventor: Toshio Kashio, Tokyo, Japan

[73] Assignee: Casio Computer Co., Ltd., Tokyo, Japan

[21] Appl. No.: 678,359

[22] Filed: Apr. 19, 1976

[30] Foreign Application Priority Data

Apr. 22, 1975 Japan ..... 50-48956

[51] Int. Cl.[2] ..... G04B 19/34; G04C 3/00; G04F 10/00

[52] U.S. Cl. ..... 58/39.5; 58/50 R; 58/74

[58] Field of Search ..... 58/23 R, 39.5, 50 R, 58/74

[56] References Cited

U.S. PATENT DOCUMENTS

| | | | |
|---|---|---|---|
| 3,757,509 | 9/1973 | Fujita | 58/23 R |
| 3,789,600 | 2/1974 | Champan | 58/39.5 |
| 3,795,099 | 3/1974 | Tsuruishi | 58/23 R |
| 3,854,277 | 12/1974 | Samejima et al. | 58/39.5 |
| 3,884,035 | 5/1975 | Jeannet et al. | 58/39.5 |
| 3,950,935 | 4/1976 | Naito | 58/39.5 |
| 3,992,871 | 11/1976 | Numabe | 58/39.5 |

*Primary Examiner*—Stanley J. Witkowski
*Attorney, Agent, or Firm*—Flynn & Frishauf

[57] ABSTRACT

A stop watch device has a time-counting circuit which is caused to count time by clock pulses from an oscillator and the count value of which is displayed on the display section. The time-counting circuit starts counting time in response to a time-count start instruction which is produced by operating a switching device. It stops counting time when the switching device is operated again at any time after the first operation. The stop watch device is further provided with a control circuit. The control circuit allows the time-counting circuit in its rest state to start counting time again in addition to the time already counted, when the switching device is operated again. It clears the count value of the time-counting circuit when the switching device is operated twice consecutively in a short time, either during the non-counting period of the time-counting circuit or during the counting period thereof.

4 Claims, 5 Drawing Figures

STOP WATCH DEVICE

This invention relates to a stop watch device wherein the time-counting operation carried out by a time-counting circuit is controlled by an operation signal which is produced by depressing a single button.

Generally, it is demanded of a stop watch device to clear the counted time, to start counting time and to stop counting time, whenever required. These functions should be alternatively selected by a switching operation. Each function is effected by an instruction signal, which is produced, for example, by depressing a specific one of the buttons. If push buttons are allotted to the respective functions as in the conventional stop watch device, it remains difficult to miniaturize the stop watch device. Provision of many push buttons in a stop watch device is a fatal defect particularly in case the stop watch is to be incorporated into an ordinary wrist watch. Among the prior art stop watch devices there is known a device which has only one push button to produce instruction signals for effecting a plurality of functions. In such a stop watch device, however, a time-count start instruction signal is produced upon the first depression of the button, a time-count stop instruction signal is then produced upon the second depression of the button, and finally a count clear instruction signal is produced upon the third depression of the button. When the push button is depressed for the fourth time, another time-count start instruction signal is produced. Namely, the different instructions signals are produced in a predetermined order, one at a time when the button is depressed.

In practical use of a stop watch device it is often desired that the counted value not be cleared even after display so that a value counted thereafter may be added to it. To achieve this, it is required that either a count clear instruction signal or a time-count start instruction be controllably produced if the time-counting circuit has stopped counting time. This selective production of instruction signals was impossible with the prior art stop watch device having a single push button.

SUMMARY OF THE INVENTION

In accordance with the present invention, a stop watch device comprises a source of clock pulse signals; a time-counting circuit coupled to the clock pulse signals; and a switch which is operable to couple a count start instruction to the time-counting circuit. Means is provided for causing the time-counting circuit to stop counting the clock pulse signals upon detection of an operation of the switch; and detection means is provided for detecting two consecutive operations of the switch made within a predetermined short period of time during which the switch can be operated twice, and for generating a detection signal responsive to the detected consecutive operations of the switch. Means is further provided for clearing the detection signal from the detection means.

DETAILED DESCRIPTION

The present invention shall be explained in detail with reference to an embodiment wherein a circuit which has a stop watch function is incorporated in a time-counting structure of an ordinary watch.

Figure 1:
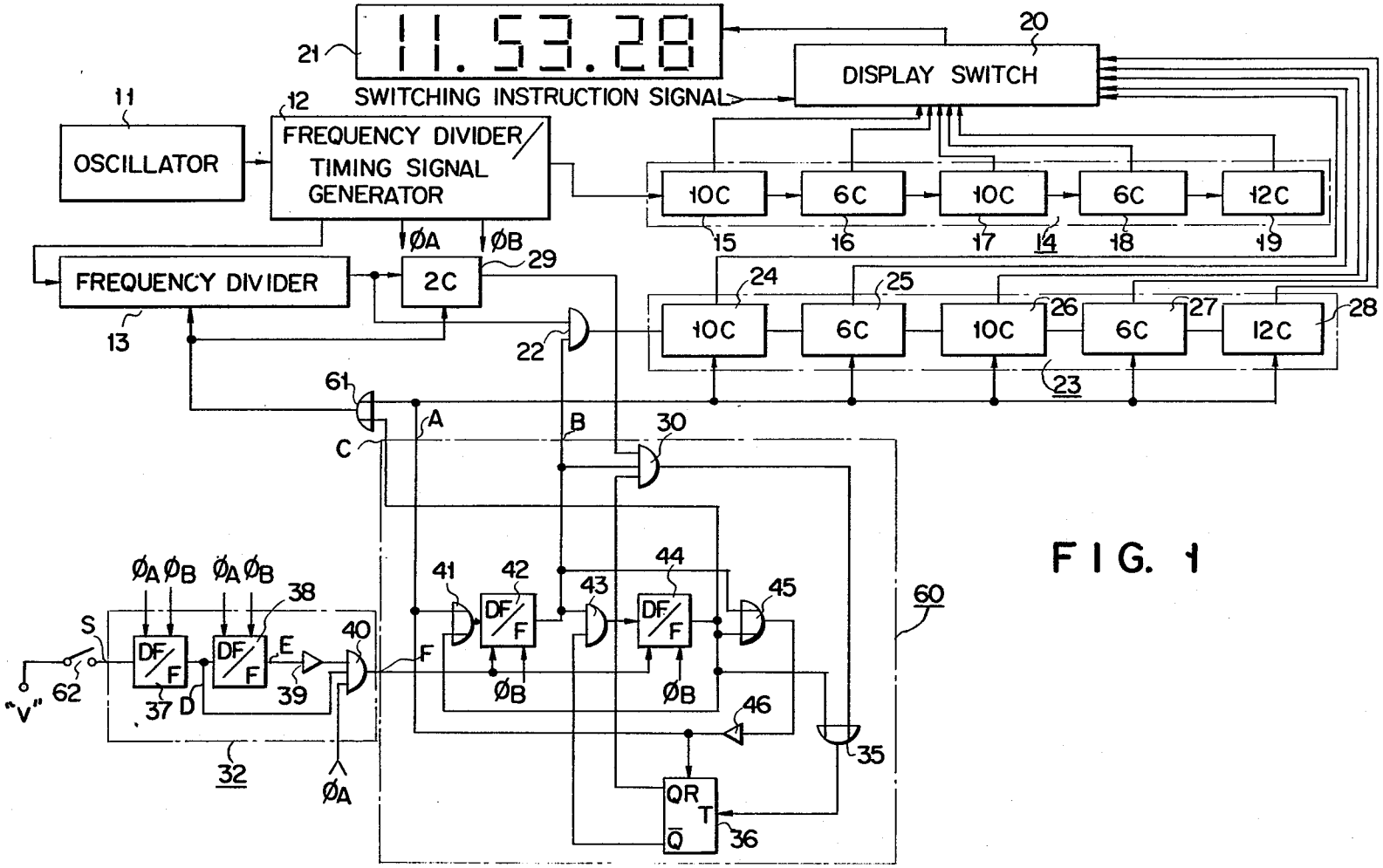
FIG. 1 is a block diagram of one embodiment of the present invention.

As shown in FIG. 1, clock signals from an oscillator 11 are passed through a circuit 12 which has a frequency-dividing function and a timing signal generating-function. The frequency divider/timing signal generator 12 produces timing signals, for example, one per second (1p/sec) these timing signals are fed into a time-counting circuit 14 which is adapted to an ordinary watch. In the time-counting circuit 14, a 10-scale counter 15 and a 6-scale counter 16 count time by the second, and a 10-scale counter 17 and 6-scale counter 18 count time by the minute, and further a 12-scale counter 19 counts time by the hour. The count value of each counter is supplied as clock signals through a display switch 20 to a display section 21. Thus, the time is displayed by the display section 21. More precisely, the display section 21 displays "hour", "minute" and "second", each in two digits. This ordinary time display can be switched to a stop watch time display by supplying a display switch instruction signal to the display switch 20.

The frequency divider/timing signal generator 12 generates signals frequency-divided more finely than the clock signals (1p/sec) and feeds the same to another frequency divider 13. At the same time it generates clock signals $\phi_A$ and $\phi_B$ which are timing signals. The frequency divider 13 generates signals, one pulse per second (1p/sec), which are supplied through an AND circuit 22 to a time-counting circuit 23 adapted to a stop watch. The time-counting circuit 23 is constituted by a 10-scale counter 24 and a 6-scale counter 25 which count time by second, 10-scale counter 26 and a 6-scale counter 27 which count time by minute, and a 12-scale counter 28 which counts time by hours. The output signals (1p/sec) from the frequency divider 13 are fed into a binary counter 29, which produces signals, each very 2 seconds (1p/2sec). The output signals (1p/2sec) of the binary counter 29 are used as control input signals to a circuit 60 which designates a specific function of the time-counting circuit 23. The circuit 60 is controlled by the output of an input control circuit 32 which receives, as input signals, the one-shot pulses generated by operating a switch 62 which is coupled to a voltage source V.

Figure 2:
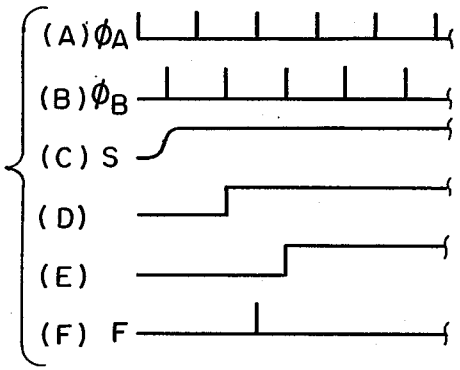
FIG. 2 shows the waveforms of signals for controlling the operation of the embodiment of FIG. 1.

The input control circuit 32 comprises delay circuits 37 and 38 each constituted by a delayed flip-flop to which switch signal S from the switch 62 is supplied, an inverter 39, and an AND circuit 40. The switch signal S rises up when the switch 62 is operated, and then an output signal rises up at the delay circuit 37. Thereafter, in response to such a clock pulse $\phi_A$ as shown in FIG. 2(A) the AND circuit 40 produces such an output pulse signal as shown in FIG. 2(F).

The circuit 60 for designating the function of the time-counting circuit 23 is provided with a circulating circuit which comprises an OR circuit 41, a delay circuit 42, an AND circuit 43 and a delay circuit 44. The delay circuits 42 and 44 are so driven as to be written upon receipt of the output signal F from the input control circuit 32 and to be read out upon receipt of such a clock pulse $\phi_B$ as shown in FIG. 2(B). The output of the delay circuit 44 is supplied through an OR circuit 45 and an inverter 46 to the OR circuit 41 and serves as gate input. Simultaneously it is supplied through an OR circuit 35 to a flip-flop circuit 36 and serves at trigger input thereto. The flip-flop circuit 36 receives, reset input, the output from the inverter 36 and produces a reset output. The reset output is fed to one gate of the AND circuit 43. The reset input of the flip-flop circuit 36 is inverted by the trigger input into a set output, which is supplied to an AND circuit 30 as gate input thereto. The OR circuit 45 receives the output of the delay circuit 42 at its one gate. The AND circuit 30 receives, as its gate input, the output of the delay circuit 42 and the output of the binary counter 29 together with the set output from the flip-flop circuit 36.

The output of the inverter 46 is represented as the output signal A of the circuit 60 as shown in FIG. 1. The signal A is supplied through an OR circuit 61 to the frequency divider 13 and also to the binary counter 29 and serves as a count clear instruction signal thereto. The output of the delay circuit 42 is represented as the output signal B of the circuit 60. It is supplied through the AND circuit 22 to the time-counting circuit 23 and serves as a time-count start instruction signal thereto. On the other hand, the output of the delay circuit 44 is represented as output signal C. It is supplied through the OR circuit 61 to the frequency divider 13 and also to the binary counter 29 and serves as a time-count stop instruction input, thereby clearing both the frequency divider 13 and the binary counter 29 but maintaining the content of the time-counting circuit 23. Thus the output signal C serves as a time-count stop instruction signal.

In the stop watch device of the above-mentioned circuit construction, while used as an ordinary watch as usual, the clock pulses from the oscillator 11 are fed as time-counting signals to the time-counting circuit 14 through the frequency divider 12, and the time-count value of the time-counting circuit 14 is supplied through the display switch 20 to the display section 21 and thereby displayed. In this condition, the time-counting circuit 23 adapted to a stop watch remains in a reset state so long as the delay circuit 42 or 44 of the circuit 60 for designating the function of the time-counting circuit 23 generates no output, since the output of the inverter 46 of the circuit 60 is, as output signal A, kept supplied through the OR circuit 61 to the frequency divider 13 and the binary counter 29.

In order to use the stop watch device of the invention as a stop watch, a switch (not shown) other than the switch 62 is operated to generate a switching instruction signal which is fed to display switch 20. In response to the switching instruction signal the display switch 20 makes the display section 21 ready to effect the stop watch time display. To cause the time-counting circuit 23 to start counting time under this condition, the switch 62 is operated, and a switch signal S rises up as shown in FIG. 2(C). Simultaneously, clock pulses $\phi_A$ and $\phi_B$ are supplied to both the delay circuit 37 and the delay circuit 38, at which output signals rise up as shown in FIGS. 2(D) and 2(E). As a result, the AND circuit 40 (or the input control circuit 32) generates a signal F shown in FIG. 2(F). Signal F is taken out as a pulse signal corresponding to clock pulse $\phi_A$ and then coupled to, as a write-in instruction signal, the delay circuits 42 and 44 of the circuit 60. At this time, the inverter 46 produces an output. The output of the inverter 46 is written into the delay circuit 42 through the OR circuit 41. Subsequently the delay circuit 42 receives a clock pulse $\phi_B$, and its output is supplied to one gate of the AND circuit 22 and serves as signal B, i.e. a time-count start instruction signal. At this time the other gate of the AND circuit 22 receives the output of the frequency divider 13, since the output of the delay circuit 42 has been fed also to the inverter 46 through the OR circuit 45 to prohibit the inverter 46 from generating an output and thus to supply no count clear instruction signal A to the frequency divider 31 or the binary counter 29. Since it receives no count clear instruction signal A, the time-counting circuit 23 is brought out of the count clear state and starts the stop watch time-counting as it is driven by the clock pulses from the AND circuit 22. While the time-counting circuit 23 keeps on counting time, the AND circuit 43 is supplied at one gate with the output of the delay circuit 42 and at the other gate with the reset output from the flip-flop circuit 36 and can thus feed its output to the delay circuit 44. However, since the delay circuit 44 receives during this period no signal F from the AND circuit 40, it generates no output and thus no time-count stop instruction signal C until the switch 62 is operated for the second time. The time-counting circuit 23 can therefore continue the time-counting which has been started upon the first operation of the switch 62, i.e. upon generation of the first signal F.

In order to make the time-counting circuit 23 stop counting time whenever desired, the switch 62 is pushed again so that the input control circuit generates a signal F. This signal F is written into the delay circuit 44 as input pulse since the AND circuit 43 stays in a position to generate an output and to feed the same to the delay circuit 44. The output of the delay circuit 44, caused to be read out by a clock pulse $\phi_B$, is thus supplied through the OR circuit 61 to the frequency divider 13 as time-count stop instruction signal C and to the binary counter 29 as reset signal. At this time the output of the delay circuit 44 is supplied to the inverter 46 through the OR circuit 45, and the inverter 46 is therefore prohibited from generating a count clear instruction signal A. Thus, the time-counting circuit 23 have the count valve not cleared and it is kept in rest state. The time when the switch 62 is operated again can be displayed by the display section 21. The time-counting circuit 23 which is in rest state, can be made to start counting time again in addition to the time that it has counted already, or the count value of the time-counting circuit 23 can be cleared, whenever the switch 62 is operated in a specific manner.

In order to count time again so that the count value may be added to the already counted one, the switch 62 is operated only once, thereby causing the input control circuit to generate a signal F. Then, the output of the delay circuit 44 is fed to the delay circuit 42 through the OR circuit 41. Since no input is fed to the delay circuit 44 at this time, the output of the delay circuit 42 can be read out by a clock pulse $\phi_B$ and causes the signal F to be read out. It is then supplied to one gate of the AND circuit 22. Since the AND circuit 22 receives at its other gate the output of the frequency divider 13, it generates an output, which is supplied to the time-counting circuit 23. Consequently, the time-counting circuit 23 can resume time-counting, so that time is further counted in addition to the count value which the circuit 23 has maintained during its rest period.

Before the time-counting circuit 23 resumes time-counting, the output of the delay circuit 44 is fed through the OR circuit 35 to the flip-flop circuit 36 as trigger signal. Upon receipt of the trigger signal the inverter 36 inverts the reset signal into a set signal. The set signal thus obtained is supplied to one gate of the AND circuit 30. Thereby the AND circuit 43 is prohibited from generating an output. The AND circuit 30 is further supplied with, as another gate input, the output of the delay circuit 42. Meanwhile the binary counter 29 is driven by an output of the frequency divider 13 and supplies an 1p/sec output 2 seconds later to the AND circuit 30. Upon receipt of the 1p/sec output of the binary counter 29 the AND circuit 30 generates an output. The output of the AND circuit 30 is supplied through the OR circuit 35 to the flip-flop circuit 36 is trigger signal. Then the inverter 36 effects another inversion, generates a reset signal and supplies the same to one gate of the AND circuit 43.

If the switch 62 is operated further under this condition, a signal F causes the output signal of the AND circuit 43 to be written into the delay circuit 44. As a result, a clock pulse $\phi_B$ makes the delay circuit 44 generate an output. The output of the delay circuit 44 is supplied to the frequency divider 13 and the 2-scale counter 29 as a time-count stop instruction signal C, thereby resetting the binary counter 29 and, at the same, make the total count value of the time-counting circuit 23 be displayed by the display section 21.

In order to clear the count value of the time-counting circuit 23 in rest state, the switch 62 is operated so as to generate a signal F, allowing the time-counting circuit 23 to count time for a moment. The switch 62 is operated again before the binary counter 29 produces an output, that is, before a 2-second period elapses, thereby generating another signal F. Subsequently, the output of the delay circuit 42 is supplied through the OR circuit 45 to the inverter 46 and prohibits the inverter 46 from producing an output. The delay circuit 42 receives no longer any input. Further the gate of the AND circuit 43 does not open since the flip-flop circuit 36 remains still in set state. Both the delay circuits 42 and 44 therefore keep emitting "zero" outputs, being driven by clock pulses $\phi_B$. Under this condition the output of the inverter 46 is then supplied as count clear instruction signal A to the frequency divider 13 and the binary counter 29, and further to the time-counting circuit 23, thereby clearing the count value of the time-counting circuit 23.

As explained above, the time-counting circuit 23 which contains no count value is caused to start stop watch time-counting upon the first switching operation of the switch 62, to stop the time-counting and have its count value displayed upon the second switching operation, and to resume the time-counting upon the third switching operation. If the switch 62 is then operated twice consecutively within a predetermined time, the count value of the time-counting circuit 23 is cleared. Or, if the switch 62 is then operated once after a predetermined period, the time-counting circuit 23 stops counting time, and the time which has displayed. That is, the clearance of the count value or the display of the count value can be selectively effected by operating a single switch 62. In ordinary stop watch time-counting it is rare that a period of less than 2 seconds should be added to the time already counted. This is why the binary counter 29 is employed so that the period within which to operate the switch 62 twice so as to clear the count value of the time-counting circuit 23 is determined to be 2 seconds. Of course, said period need not be limited to 2 seconds. It may be any other length of time.

Figure 3:
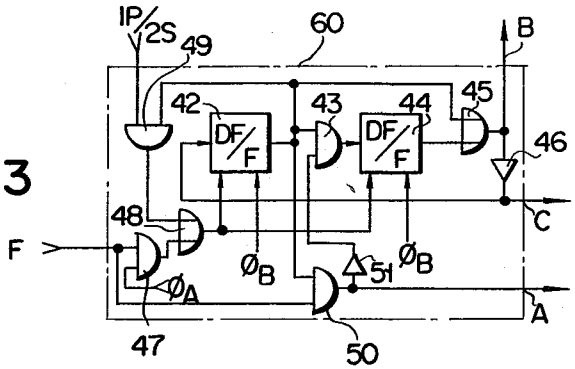
FIGS. 3 to 5 show each an embodiment of the circuit for controlling the operation of the time counter also illustrated in FIG. 1.

With reference to FIG. 3 another embodiment of the circuit 60 shall be now described. In this embodiment of the circuit 60, a clock pulse $\phi_A$ is not fed into an AND circuit 40 of the input control circuit 32, and the signal F from the AND circuit 40 of the input control circuit 32 is supplied through an AND circuit 47 and an OR circuit 48 to a delay circuit 42 as input pulse signal thereto. The signal F has a pulse width which is determined by the manner of switching operation. From the AND circuit 47 it is emitted by a clock pulse $\phi_A$ which is obtained in response to the switching operation.

The circuit 60, like the embodiment of FIG. 1, comprises a delay circuit 42, an AND circuit 43, a delay circuit 44 and an OR circuit 45. The delay circuits 42 and 44 are so driven that their write-in operation is controlled by clock pulses $\phi_A$ obtained from the AND circuit 47 through the OR circuit 48 and their read-out operation is controlled by clock pulses $\phi_B$. On the output side of the OR circuit 45 an inverter 46 is provided. The output signal of the inverter 46 is coupled to the input side of the delay circuit 42, and it serves as a time-count stop instruction signal C. The output signal of the delay circuit 42 is supplied to the OR circuit 45 and further to AND circuits 49 and 50. To the AND circuit 49 there are coupled 1p/2sec signals from the counter 29. To the AND circuit 50 there are coupled pulse signals from the input control circuit 32. The output signal of the AND circuit 49 is let to the OR circuit 48, while the output signal of the AND circuit 50 is taken out as a count clear instruction signal A. To the output side of the AND circuit 50 an inverter 51 is connected. The output signal of the inverter 51 serves to control the gate of the AND circuit 43.

In the circuit 60 of the above-mentioned construction both delay circuits 42 and 44 remain clear and their outputs are "0", as long as no switching operation is made, thus generating no signal F. To start stop watch time-counting under this condition, the switch 62 is operated to generate a signal F. The signal (or pulse) F is written into both the delay circuit 42 and the delay circuit 44. At this time the inverter 46 supplies its output to the delay circuit 42. Urged by a read-out clock pulse $\phi_B$, the delay circuit 42 produces an output. The output of the delay circuit 42 is supplied through the OR circuit 45 to the time-counting circuit 23 and serves as time-count start instruction signal B. At the same time the output of the OR circuit 45 prohibits the inverter 46 from emitting an output to the delay circuit 42. The output of the delay circuit 42, however, is fed also to one gate of the AND circuit 49. The other gate of the AND circuit 49 receives a pulse signal (1P/2 sec) 2 seconds after the time-counting circuit 23 has started stop watch time-counting. Then the AND circuit 49 generates an output, which is supplied through the OR circuit 48 to both delay circuits 42 and 44 as write-in pulse thereto. At this time, the delay circuit 42 receives the "0" output of the inverter 46, while the delay circuit 44 receives at one gate the output of the delay circuit 42 and at the other gate the output of the inverter 51. As a result, urged by read-out clock pulses $\phi_B$, the delay circuits 42 and 44 generates a "0" output and a "1" output, respectively. Consequently, the output of the delay circuit 44 is supplied through the OR circuit 45 to the time-counting circuit 23 as a time-count start instruction signal B, whereby the time-counting circuit 23 continues to count time.

In order to stop the time-counting under this condition, the switch 62 is operated again, thereby to supply a signal F to the AND circuit 47 of the circuit 60. The signal F is therefore fed to both delay circuits 42 and 44 as write-in pulse. Concurrently, the "0" output of the inverter 46 is written into the delay circuit 42, and the output of the AND circuit 43, which is a "0" output since the signal F prohibits the inverter 51 from producing an output, is written into the delay circuit 44. As a result, both delay circuits 42 and 44, urged by read-out pulses $\phi_B$, produce "0" outputs. Thereby a "1" output is obtained from the inverter 46 and is supplied to the time-counting circuit 23 as a time-count stop instruction signal C. Consequently, the time-count circuit 23 stops counting time.

To start again the stop watch time-counting under this condition so that time is counted in addition to the time already counted, the switch 62 is operated again time. Since the inverter 46 remains in a position to produce an output, its output is supplied to the delay circuit 42. Then, as mentioned before, the output of the delay circuit 42 is supplied through the OR circuit 45 to the time-counting circuit 23 as a time-count start instruction signal B. If the switch 62 is again operated some time (e.g. longer than 2 seconds) after the time-counting has been resumed, the time-counting circuit 23 stops counting time, and the time which the circuit 23 has counted is displayed. By repeatedly operating the switch 62 thereafter the time-counting is started and stopped, and the time which the time-counting circuit 23 has counted is displayed.

On the other hand, if the switch 62 is operated within 2 seconds after the time-counting has been resumed, the signal F is supplied to the AND circuit 50 as gate input thereto. The output of the AND circuit 50 is then supplied to the time-counting circuit 23 as a count clear instruction signal A, thereby clearing the count value of the time-counting circuit 23. Subsequently, the output of the inverter 51 closes one gate of the AND circuit 43. As a result, the delay circuit 44 generates a "0" output. Similarly the output of the delay circuit 42 is made to be a "0" output by the output of the inverter 46. Thus, both delay circuit 42 and 44 produce "0" outputs, and are brought into initial state.

As mentioned above, also the circuit 60 of FIG. 3 makes it possible to select easily the function of the time-counting circuit 23 merely by controlling the switching operation of a single switch.

Figure 4:
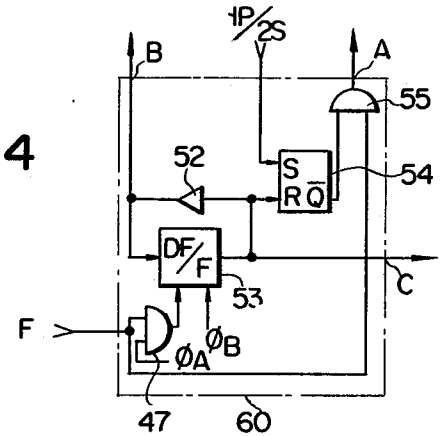

In another embodiment of the circuit 60 as shown in FIG. 4, a signal F generated upon operation of the switch 62 is supplied as gate input to an AND circuit 47. Driven by a clock pulse $\phi_A$, the AND circuit 47 generates an output, which is written into a delay circuit 53 as an input pulse. Between the input and output terminals of the delay circuit 53 an inverter 52 is connected. Every time it receives a clock pulse $\phi_A$, the inverter 52 has its output inverted. Thus, the delay circuit 53 and the inverter 52 form a circulating circuit. The output of the delay circuit 53 serves as a time-count stop instruction signal C to the time-counting circuit 23, while the output of the inverter 52 serves as a time-count start instruction signal B. Further there is provided a flip-flop circuit 54 which receives as set input the output signal (1p/2 sec) of the binary counter 29 shown in FIG. 1 and as reset input the output of the delay circuit 53. The output which the flip-flop circuit 54 generates upon receipt of the reset signal and the signal F which is generated upon operation of the switch 62 are supplied to the respective gates of an AND circuit 55. The output of this AND circuit 55 serves as a count clear instruction signal A to the time-counting circuit 23. Namely, under control of the switching operation the time-count stop instruction signal C or the time-count start instruction signal B selectively causes the time-counting circuit 23 to stop or start counting time; they are always in such relationship that one is an inverted output of the other. On the other hand, the count clear instruction signal A is emitted from the AND circuit 55 if a signal F is generated by the switching operation before the signal (1p/2 sec) is fed into the flip-flop circuit 54, that is, within 2 seconds after the time-count stop instruction signal C has risen up.

Figure 5:
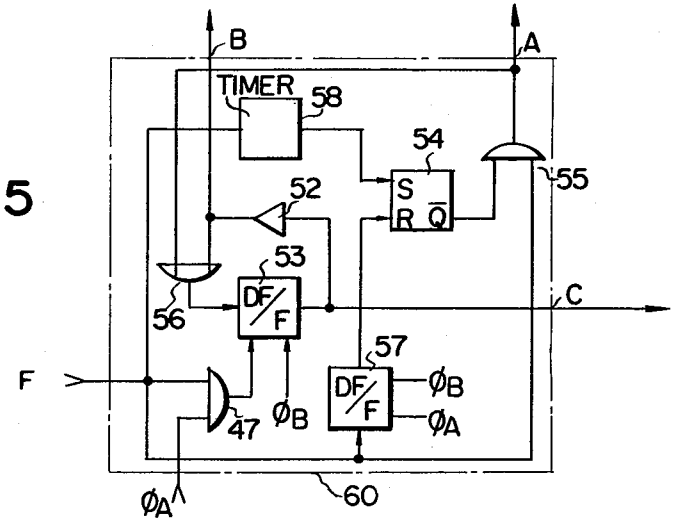

In any one of the preceding embodiments of the circuit 60, the clearance of the count value of the time-counting circuit 23 is conducted by controlling the switching operation after the time-counting has been stopped. This is sufficient in ordinary stop watch time-counting. But it is possible to clear the count value even if the time-counting circuit 23 goes on counting time, using another embodiment of the circuit 60 as illustrated in FIG. 5.

Namely, the signal F generated by the switching operation is fed to one gate of an AND circuit 47, while a clock pulse $\phi_A$ generated correspondingly with the signal F is fed to the other gate of the AND circuit 47. The output of the AND circuit 47 is written into a delay circuit 53 as input pulse. At the input side of the delay circuit 53 an inverter 52 and an OR circuit 56 are connected in series. The delay circuit 53, the inverter 52 and the OR circuit 56 form a circulating circuit wherein the output of the delay circuit 53 is inverted every time a clock pulse $\phi_A$ is supplied. The output of the delay circuit 53 serves as a time-count stop instruction signal C, and that of the inverter 52 serves as a time-count start instruction signal B.

At the same time, the signal F is supplied through a timer 58 to the set input terminal of a flip-flop circuit 54 and through a delay circuit 57 also to the reset input terminal of the flip-flop circuit 54. The reset output of the flip-flop circuit 54 is supplied to one gate of an AND circuit 55. To the other gate of the AND circuit 55 the signal F is supplied. Then, the output of the AND circuit 55 is coupled to one gate of an OR circuit 56 and, simultaneously, supplied to the time-counting circuit 23 as a count clear instruction signal A. In order to cause the time-counting circuit 23 which keeps counting time since instructed by the time-count start instruction signal B to stop the time-counting operation, the switch 62 is operated, thus generating another signal F. The signal F thus produced is supplied to the delay circuit 53 as an input pulse thereto. Then, driven by a clock pulse $\phi_B$, the delay circuit 53 emits an output, i.e. time-count stop instruction signal C, which prohibits the signal B from being emitted from the inverter 52 and causes the time-counting circuit 23 to stop counting time. The count value of the time-counting circuit 23 at this moment can be displayed.

After a time longer than a predetermined period (set by the timer 58) from the stop of the time-counting, the switch 62 may be operated to generate a signal F, thereby causing the time-counting circuit 23 again to start counting time in addition to the count value. Upon each signal F the flip-flop circuit 54 is reset through the delay circuit 57. If a signal F is generated within the period set by the timer 58 from the generation of the preceding signal F, the AND circuit 55 generates an output which serves as a count clear instruction signal A, and at the same time an input signal is supplied to the delay circuit 53 through the OR circuit 56. When another signal F is generated under this condition, the delay circuit 53 is driven by a clock pulse $\phi_B$ to produce a time-count stop instruction signal C, thereby causing the time-counting circuit 23 to stop counting time.

In the embodiment of FIG. 1 the switching instruction signal to the display switch 20 is generated by a switch provided separately. But the switching instruction signal may be automatically generated while the stop watch time-counting is conducted.

As aforementioned, the embodiment of the invention described so far is incorporated in an ordinary watch. Instead the stop watch device according to the invention can of course be separated from the ordinary watch.

In the illustrated embodiment, the stop watch time-counting is conducted in the units of hour, minute and second. But time-counting is not necessarily limited to this. Time may be measured, for example, by by the tenth of a second. Further, in the illustrated embodiment the ordinary watch time and the stop watch time are alternatively displayed by the same display section. Of course, two display sections may be provided so that the ordinary watch time is displayed by one display section and the stop watch time by the other.

In case the same display section is used to display the ordinary watch time or the stop watch time, the display switching may be conducted between the ordinary watch time and the stop watch time, while it is detected that the stop watch device is in operation. To achieve this, the display switching may be effected by the signal B and the signal C.

What is claimed is:

1. A stop watch device comprising:

a source of clock pulse signals;

a time-counting circuit coupled to said source of clock pulse signals for counting the clock pulse signals;

a switch for coupling a count start instruction to said time-counting circuit upon a given operation of said switch;

means coupled to said time-counting circuit and to said switch for causing said time-counting circuit to stop counting said clock pulse signals upon detection of another operation of said switch after said given operation thereof;

detection means coupled to said switch for detecting two consecutive operations of said switch made within a predetermined short period of time during which said switch can be operated twice, and for generating a detection signal responsive to said detected consecutive operations of said switch; and means coupled to said detection means and to said time-counting circuit for clearing said time-counting circuit in response to said detection signal from said detection means.

2. A stop watch device according to claim 1 further comprising a further time-counting circuit coupled to said source of clock pulse signals and driven by said clock pulse signals so as to effect time-of-the-day time-counting.

3. A stop watch device according to claim 1 wherein said detection means comprises means for detecting said consecutive operations of said switch which are made while said time-counting circuit is not counting clock pulse signals.

4. A stop watch device according to claim 1 wherein said predetermined short period of time is less than 2 seconds.

* * * * *